United States Patent [19]

Drever

[11] Patent Number: 4,600,077

[45] Date of Patent: Jul. 15, 1986

[54] MICROPHONE WIND SHROUD

[76] Inventor: Leslie C. Drever, 8351 Columbus Ave., Panorama City, Calif. 91402

[21] Appl. No.: 695,168

[22] Filed: Jan. 25, 1985

[51] Int. Cl.[4] ..... F01N 7/00

[52] U.S. Cl. ..... 181/242; 181/158; 179/179; 179/184

[58] Field of Search ..... 181/158, 242; 179/121 R, 179, 180, 184

[56] References Cited

U.S. PATENT DOCUMENTS 2,520,706 8/1950 Anderson et al. ..... 181/242

3,652,810 3/1972 Weingartner ..... 179/184

*Primary Examiner*—Benjamin R. Fuller

*Attorney, Agent, or Firm*—Blakely, Sokoloff, Taylor & Zafman

[57] ABSTRACT

A microphone wind shroud having a integral mounting means for being slidably mounted to an omnidirectional or unidirectional microphone, such as those integrally mounted on video cameras. A semi-rigid grid-like external shell shrouds the microphone head. The shell is lined with a multilayer laminate fabric material. The shell and laminate allow desired audio frequencies to pass and reach the microphone head while attenuating undesired wind noises caused by microphone movement or environmental wind conditions.

7 Claims, 3 Drawing Figures

Fig. 1
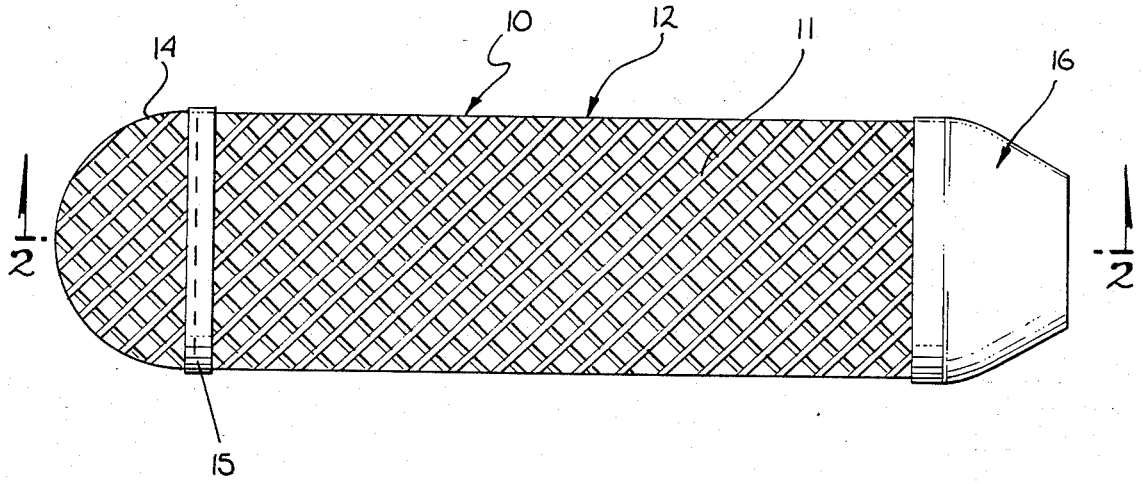
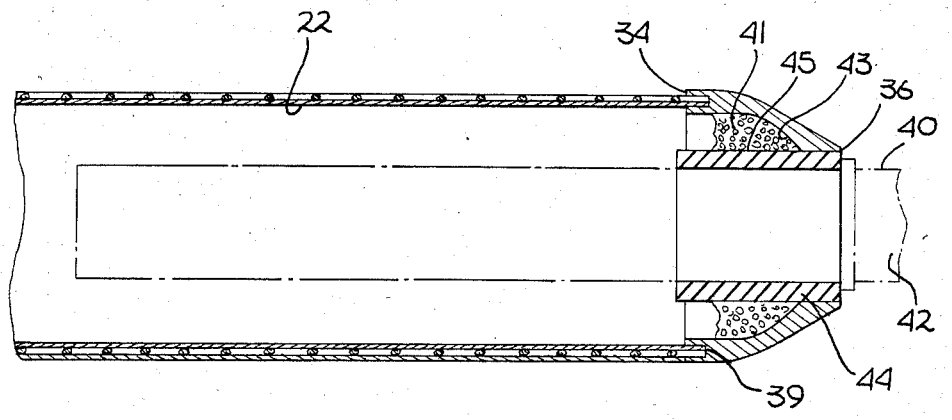
Fig. 2
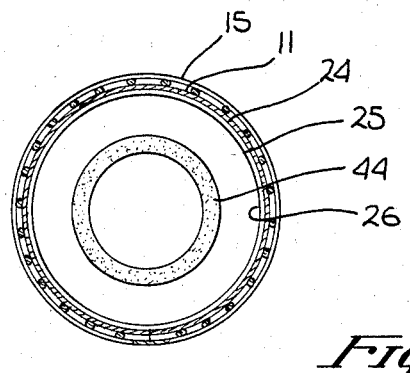
Fig. 3

MICROPHONE WIND SHROUD

BACKGROUND OF THE INVENTION

A wide variety of applications in science, industry and entertainment require high quality reproduction of sound using available sound recording techniques and equipment. High-quality, low-noise sound reproductions, for example, are of critical importance in the television and movie industry. There, crisp, clean voice and dialog reproduction must be achieved despite ambient and background noise levels of moderate to high amplitude.

One frequently encountered source of undesirable background noise is caused by air moving relative to the sound transducing device, which is most typically an omnidirectional or unidirectional microphone. As a result, a "whooshing" or rushing sound is imposed on the desired audio, thus resulting in deteriorated sound quality.

This type of noise may occur due to environmental or operational requirements and conditions. For example, wind noise often occurs when a microphone is panned during an indoor shoot, whether on a boom or simply held in hand with an extension. Likewise, such noise may be caused by forced air movement such as by fans or dynamic special effects equipment.

In certain applications, such as speeches or movie productions, unidirectional microphones are used which can reject most rear and lateral wind noise. However, this reduction is only effective at very low relative velocities, and will not reduce head-on wind noise. Further, unidirectional microphones are not suitable for all applications.

There are several prior art schemes that have been employed in an attempt to eliminate or reduce microphone wind noises. One is the use of a foam "sock" which is pulled over the microphone head. However, foam socks tend to physically deteriorate over time. As a result, foam particulates often fall into the microphone head, causing damage and reduced performance. Also, foam socks suffer the drawback of only being effective to reduce wind noise due to very slight breezes,. up to approximately three miles per hour. This is a severe limitation in a broad spectrum of standard outdoor and indoor operating environments essential to the film and television industry. To overcome this limitation, electronic filtering techniques have been used to filter out wind noise resulting from velocities exceeding three miles per hour. Unfortunately, electronic filtering also attenuates desired audio frequencies, thereby substantially degrading sound quality.

Another prior art scheme used to reduce wind noise is the use of a gun-type microphone windshield. This device typically consists of suspending or supporting the microphone on a pair of suspension mounts, and enclosing the microphone in a plastic mesh cylinder lined with a wind interfering material. The suspension mounts, however, can obstruct the soundfield near the front of the microphone. Also, these units include a large air space between the interior surface of the windshield and the surface of the microphone. Thus, the diameter of the windshield is typically 3 to 5 times larger than the diameter of the microphone, and may intefere with a scene.

The prior art suspension mount wind shield also suffers the drawback of being bulky and cumbersome to handle. In addition, they are not suitable for direct mounting on home or professional video equipment which commonly include an integral microphone, because of their size and because they require an air gap which creates a large diameter apparatus.

SUMMARY OF THE INVENTION

A microphone wind shroud for attenuating microphone noise resulting from the relative movement of air with respect to a microphone is described. The present invention is a unitary structure that is slidably receivable onto the neck of a microphone having an integral suspension for resiliently retaining the wind shroud in place. The mounting means incorporates a combination closed-cell and open-cell foam suspension support sections.

The wind shroud is a narrow cylindrical body which aligns with the shape of the microphone and can therefore fit between the narrow spaces provided between the microphone mount and the camera in modern video camera equipment. A grid-like structure covered with a multilayer laminate material provides for attenuation of undesired wind noise of speeds of up to 25 miles per hour while allowing desired audio frequencies, such as speech and music to pass freely to the transducer element of the microphone. It is therefore one object of the present invention to provide a microphone wind shroud that can be easily and inexpensively manufactured while providing superior attenuation over prior art attenuation methods. It is a further object of the present invention to provide a microphone wind shroud that is compact for being used with modern day microphones mounted to mini-camera equipment. It is a further object of the present invention to provide a resilient lightweight integral wind shroud suspension mount so that mechanical deflection and vibration is eliminated or substantially reduced without compromising the secure fit of the wind shroud to the microphone.

Other objects and attendant advantages of the present invention will become more apparant upon a reading of the specification and examination of the drawings in which, like reference numerals refer to like parts throughout and in which:

DETAILED DESCRIPTION OF THE DRAWINGS

FIG. 1 is a plan view of the Microphone Wind Shroud.

FIG. 2 is a cross-section of the Microphone Wind Shroud taken along Line 2—2 of FIG. 1.

FIG. 3 is a cross-section of the Microphone Wind Shroud taken along the front section thereof.

DETAILED DESCRIPTION OF THE INVENTION

The present invention relates to an article of manufacture for attentuating microphone noise caused by the relative motion of air moving with respect to a microphone. Referring generally to FIG. 1, a preferred embodiment of the present invention is shown in plan view. The microphone wind shroud 10 consists of a substantially cylindrical body 12, head 14, and mount 16. The cylindrical body 12 and head 14 are composed of a plastic material, such as polyethelyene, which is formed in a gridlike pattern. The body and head operate as a resilient protective element that protects the microphone and gives the present invention its external form, and simultaneously allows desired audio frequency sound waves, such as speech or music, to pass through the grid openings.

The head 14 is a molded hemispherical section of the polyethylene plastic grid material. The head 14 is secured to the body 12 with a polyethylene lamination 15 or other suitable binding method so as to form a contiguous sealed unit with the body 12. Unlike solid plastic rings which can be crushed and do not accomodate the resilient grid material flexibility, the plastic laminate is light and can be deformed plastically and resiliently. Also, the laminate is lighter than a foam and provides a low contiguous profile for accomodating an additional one-layer of sound alternating material.

The body may be formed from a sheet of grid material which is formed into a cylinder and then sealed along it longitudinal seam with a laminate or suitable adhesive. Alternatively, the body can be formed as a unitary cylindrical structure using molding or other forming techniques widely known in the art.

Referring now to FIG. 3 the interior surface of the body and head are lined completely with a fabric lining 22. In the present preferred embodiment, this lining is composed of a multilayer laminate material.

As best illustrated in FIG. 3 the laminate includes an upper layer of napped nylon 24, an intermediate layer of open cell polyurethane foam 25, and a lower layer of woven nylon 26. The three layers are glued together using a resin or other suitable adhesive. The laminate 22 is securely affixed to the interior surface 50 of the head and body with the napped nylon layer exposed through the grid openings of the webbing such that the laminate conforms uniformly to the webbing surface contour.

The laminate structure, combined with the webbing, serves as a wind interfering and muffling medium. Thus, audio frequencies are able to pass through the wind shroud to the microphone, while undesirable wind noise is broken up and attenuated by the baffling effect of the combined laminate and grid structure.

As shown in FIG. 1, the microphone wind shroud includes a mount 16 which is easily securable directly to a camera mounted microphone or other microphone of selected dimensions. The mount 16 is a unitary piece of molded plastic or other resilient composition which has a body-mounting end 34 and a microphone connector end 36. The body 12 of the wind shroud 10 is fixedly secured to the body-mounting end 34 along channel 38. The channel has an internal groove 39 which is matably received about the circumfrence of the back end of the wind shroud body. The body mounting end 34 of the mount is retained about the first lip 35 by a suitable adhesive, such as cyanoacrylate, plastic adhesive or other suitable adhesive.

As shown in FIG. 1, and as further illustrated in FIG. 2 showing a cross section of the wind shroud taken along line 2—2, the mount has a gradual taper which narrows to a reduced diameter at the microphone connector end 36 to accomodate the neck 40 of the microphone 42.

A closed-cell cylindrical foam insert 44 having an outer diameter approximately equal to that of the inner diameter of the microphone connector end 36, aligns with the microphone connector end 36 and extends inward therefrom. It is adhesively maintained in that position by being resiliently packed therein with open-celled plastic foam 41 which fills the region between the inner surface 43 of the mount and the outer diameter of the insert 45. Thus, a shock and sound absorbent connection is achieved which securedly retains the microphone wind shroud to the microphone.

Referring generally to FIG. 2, the microphone wind shroud is shown in its mounted condition on the integral microphone 42.

The wind shroud is mounted to this position easily by simply sliding the wind shroud down the neck of the microphone until the mount 16 engages with the base of the microphone neck. The mount 16 is designed to engage with the neck with a tight interference fit such that the foam insert 44 is maintained in compression when mounted, so that the wind shroud is retained rigidly in place.

The above-described mount 16 provides a resilient connection and support which protects the microphone from shock and vibration and also allows the wind shroud to be deflected if struck, without bending or otherwise damaging the microphone. Thus, the shroud not only substantially reduces or eliminates wind noise but also protects the microphone head. Because of the wide variety of environments and rugged operating conditions that video cameras are exposed to, the physical protection to the microphone acheived by the present invention can substantially increase the working life of the microphone.

In addition to protecting the microphone from injury due to droppage and the like, the present invention also provides resistance to other mechanical and environmental intrusions such as rain and snow. Further, unlike prior art wind noise reducing devices like foam socks, the foam interface between the microphone, mount and hard plastic shell that surrounds the mount of the present invention, isolates camera motor noise eminating from video camera auto-focus motor and other motorized internal components thereof. Further, the sound baffling meduim of the wind shroud dampens noise by attenuating the higher frequencies of motor noise, which, unlike frequencies for human speech, do not pass freely through the present invention.

The above-described mounting arrangement overcomes numerous disadvantages of the prior art. For example, prior art wind noise reduction schemes that are able to attenuate moderate and high wind speeds cannot be fitted directly over the microphone. They typically incorporate a large air gap and independent shock mounts, requiring a diameter of 4 to 8 inches for a 1 inch diameter microphone. They also are typically too long for many applications because they must enclose both ends of the microphone. Such prior art devices could not be accomodated in the small circumferential area surrounding the microphone on modern mini-cameras used both in the home and in industry.

Additionally, the present invention eliminates the necessity for expensive and multiple independent shock mounts, which also require additional manufacturing and mounting steps. There are significantly fewer manufacturing steps required to manufacture the present invention to provide the same anti-rumble advantages acheived by more complicated prior art assemblies.

Physical protection not previously available in "foam sock" type wind noise reducers, as well as increased wind noise attenuation is also achieved by the present inventive wind shroud. Similarly, complex electronic sound filtering, which is expensive and subject to on-location failure and requires a power source, is unnecessary. Thus, using the present invention, high-quality sound reproduction can be achieved in winds up to the twenty-mile-an-hour range inexpensively and using a minumum of space.

The fabrication of the present invention can be accomplished using off-the-shelf plastic grid stock and laminate fabrics, and readily available adhesive. To fabricate the wind shroud, the fabric laminate is assembled by binding the respective laminate layers together. The laminate composite is then heat-laminated to the plastic grid stock. The grid is then formed into a cylinder, which is adhesively joined at a seam along the longitudinal axis of the cylinder by laminating a strip of polyethelyne along the aligned seam edges. Alternatively, a pre-formed cylindrical grid can be used and other adhesive may also be used to join the seam. The head is molded to form a hemisphere using heat forming, or other fabricating techniques widely known in the art. It is then mounted to the second lip 48 of the body with polyethelyne laminate or other suitable adhesive to the cylinder.

The mount 16 is hard-cast plastic which also can be molded extruded or otherwise manufactured for a particular application. The closed-cell foam rubber insert is then inserted through the end of the mount shell to align flush therewith. The void between the insert and inner wall of the mount is then filled with plastic open-cell foam to provide a light and strong means to securely hold the insert in place.

In this manner, a simple, inexpensive and effective manufacture of the present microphone wind shroud having a substantially reduced diameter and increased efficiency over prior art wind noise reducing devices, is accomplished in the present invention.

Having described the above invention what is claimed is:

1. A microphone wind shroud comprising:

a resilient annular body member having cutout portions therethrough and being opened at a first and second end;

a wind noise attenuation medium of laminate material including a first layer of napped nylon, a second layer of open-cell polyurethane foam, and a third layer of woven nylon securedly maintained immediately over said cutout portions;

a hollow head member having cutout portions therethrough and having an opening at the first end thereof, said head member being fixedly secured to said body member about the periphery of the respective first ends thereof forming a unitary shroud section opened at one end for being placed over the transducing end of a microphone;

said cutout portions of said body member and said head member comprising a flexible plastic grid of polypropylene plastic;

an annular mount section having a first end fixedly secured to said open end of said shroud section, and a second end;

a resilient cylindrical foam insert aligned along the longitudinal axis of said second end, and a foam retaining means between the outer periphery of said foam insert and the inner periphery of said annular mount section for retaining said foam insert in place such that said microphone wind shroud is slidably securable to a microphone by sliding said microphone through said foam insert;

whereby said wind shroud is securely maintained on said microphone by the gripping force of said compressive foam insert;

and whereby wind noise is attenuated by said wind shroud but desired audio frequencies pass freely therethrough.

2. The microphone wind shroud as claimed in claim 1 wherein said annular body member comprises a substantially cylindrical annulus.

3. The microphone wind shroud as claimed in claim 1 wherein said annular mount member comprises a substantially cylindrical annulus near said first end thereof, and tapers to a reduced diameter to the terminous of said second end thereof, and wherein said annular mount member further includes a circumferential edge along the first end thereof which is matably and adhesively secured to the second end of said body member.

4. The microphone wind shroud as claimed in claim 1 wherein said foam insert comprises a foam rubber insert having an inner diameter smaller that the outer diameter of said microphone at the area of connection such that said foam rubber insert maintains a secure an tight interference fit with the neck of said microphone and such that said insert is maintained in compression thereon.

5. The microphone wind shroud as claimed in claim 1 wherein said foam retaining means comprises open-cell plastic foam filled between the outer circumference of said foam insert an the inner circumference of said annular mount section such that a lightweight shock absorbent connection is provided between said microphone and said wind shroud.

6. The microphone wind shroud as claimed in claim 1 wherein said head member is fixedly secured to said body member using a polyethylene laminate to bind the periphery of the respective first ends such that a contiguous linear profile at the joined area is obtained.

7. A microphone wind shroud comprising:

a substantially cylindrical resilient annular body member opened at a first end and a second end thereof;

a hemisherical hollow head member having an opening at a first end thereof, said head member being fixedly secured to said body member about the periphery of the respective first ends thereof thereby forming a unitary shroud section opened at one end for being placed over the transducing end of a microphone, said annular body member and said annular head member being fabricated from a flexible plastic grid of polypropylene plastic material to allow the free passage of audio frequencies therethrough;

a wind noise attenuation meduim secured immediately over said cutout portions including a first layer of napped nylon, a second layer of open-celled polyurethane foam and a third layer of woven nylon, said layers being laminated together and adhesively secured to the inner periphery of said annular body member and said annular head member;

an annular mount member including a substantially cylindrical annulus near the first end thereof and a tapered section reduced in diameter to the terminous of the second end thereof, said annular mount member being fixedly secured to the second end of said annular body member, and further including a circumferential channel along the first end thereof for being matably and adhesively secured to the circumferential edge of the second end of said body member;

a resilient cylindrical foam rubber insert having an inner diameter smaller than the outer diameter of a microphone at the area of engagement between said microphone and said microphone wind shroud such that said foam rubber insert is maintained in compression thereon provide a secure intereference fit between the neck of said microphone and said insert;

an open-cell plastic foam retaining means filling the gap between the outer circumference of said foam insert and the inner circumference of said annular mount section;

whereby said shock mount allows for the mechanical deflection of said microphone wind shroud when mounted on said microphone without causing damage thereto, and wherein said annular mount section provides for absorbtion of mechanical shock to the microphone and motor noise caused by video camera mechanisms;

an annular channel about the periphery of said annular mount section on the first end thereof for engaging the lip of the second end of said cylindrical body section and adhesively adhered thereto;

whereby unwanted sound frequencies caused by the movement of air with respect to the wind shroud are attenuated such that only desired audio frequency sound reaches the microphone transducer.

* * * * *